US012704124B2

(12) United States Patent
Waldhoer et al.

(10) Patent No.: US 12,704,124 B2
(45) Date of Patent: Aug. 11, 2026

(54) POWER END OF RECIPROCATING PUMP WITH FASTENER ASSEMBLY

(71) Applicant: GD Energy Products, LLC, Tulsa, OK (US)

(72) Inventors: Timo Waldhoer, Tahlequah, OK (US); Randall Turner Hall, Jr., Claremore, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 40 days.

(21) Appl. No.: 18/438,855

(22) Filed: Feb. 12, 2024

(65) Prior Publication Data

US 2025/0257726 A1 Aug. 14, 2025

(51) Int. Cl.

| | |
|---|---|
| ***F04B 53/16*** | (2006.01) |
| ***F04B 1/0538*** | (2020.01) |
| ***F04B 19/22*** | (2006.01) |
| ***F04B 53/00*** | (2006.01) |
| ***F04B 53/22*** | (2006.01) |

(52) U.S. Cl.

CPC ..... *F04B 53/16* (2013.01); *F04B 1/0538* (2013.01); *F04B 19/22* (2013.01); *F04B 53/006* (2013.01); *F04B 53/22* (2013.01)

(58) Field of Classification Search

CPC ..... F04B 53/144; F04B 19/22; F04B 53/006; F04B 53/22; F04B 1/053; F04B 1/0538; F04B 53/16

See application file for complete search history.

(56) References Cited

U.S. PATENT DOCUMENTS

| | | | | |
|---|---|---|---|---|
| 11,208,996 | B2 | 12/2021 | Foster et al. | |
| 11,346,339 | B2 | 5/2022 | Nowell et al. | |
| 2010/0129249 | A1* | 5/2010 | Bianchi | F04B 39/14 417/521 |
| 2016/0025090 | A1* | 1/2016 | Bayyouk | F04B 53/16 92/161 |
| 2020/0386221 | A1* | 12/2020 | Pham | F04B 53/14 |
| 2022/0106951 | A1* | 4/2022 | Foster | F04B 15/02 |
| 2022/0163034 | A1 | 5/2022 | Foster et al. | |
| 2022/0282725 | A1 | 9/2022 | Nowell et al. | |
| 2022/0389916 | A1 | 12/2022 | Keith et al. | |
| 2023/0003207 | A1 | 1/2023 | Foster et al. | |
| 2023/0050603 | A1 | 2/2023 | Foster et al. | |

* cited by examiner

*Primary Examiner* — David N Brandt

(74) *Attorney, Agent, or Firm* — Edell, Shapiro & Finnan, LLC

(57) ABSTRACT

A power end frame includes a plurality of rings cooperatively defining an interior of the power end frame configured to enclose a portion of a crankshaft of a power end of the reciprocating pump and a rod extending through each ring of the plurality of rings to couple each ring with an adjacent ring of the plurality of rings.

11 Claims, 12 Drawing Sheets

POWER END OF RECIPROCATING PUMP WITH FASTENER ASSEMBLY

TECHNICAL FIELD

The present disclosure relates to the field of high pressure reciprocating pumps and, in particular, to a power end of high pressure reciprocating pumps.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. For example, the power end includes a crankshaft that drives a plurality of reciprocating plungers or pistons near or within the fluid end to pump fluid at high pressure. The power end also includes a frame that supports and encloses components of the power end, such as the crank shaft. The frame is arranged to withstand stress (e.g., a mechanically induced stress, a hydraulically induced stress) being produced during operation of the reciprocating pump to enable desirable performance of the reciprocating pump.

SUMMARY

The present application relates to a power end frame of a reciprocating pump. The techniques discussed herein may be embodied as a power end frame, a method for assembling a reciprocating pump, and a reciprocating pump.

More specifically, in accordance with at least one embodiment, the present application is directed to a power end frame of a reciprocating pump. The power end frame includes a plurality of rings cooperatively defining an interior of the power end frame configured to enclose a portion of a crankshaft of a power end of the reciprocating pump and a rod extending through each ring of the plurality of rings to couple each ring with an adjacent ring of the plurality of rings.

In accordance with another embodiment, the present application is directed to a method. The method includes aligning a plurality of rings with one another to define an interior of the power end frame configured to enclose a portion of a crankshaft of a power end of the reciprocating pump, inserting a rod through the plurality of rings, and securing the plurality of rings together with the rod.

In accordance with yet another embodiment, the present application is directed to a reciprocating pump. The reciprocating pump includes a fluid end configured to enclose a reciprocating element configured to receive and discharge fluid and a power end configured to enclose a portion of a crankshaft configured to operate the reciprocating element. The power end includes a plurality of rings, each ring of the plurality rings having a base and a flange extending from the base, as well as a rod extending through the flange of each ring of the plurality of rings.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the disclosure, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the disclosure. Embodiments of the disclosure will be described by way of example, with reference to the above-mentioned drawings showing elements and results according to the present disclosure.

Generally, the present application is directed to a power end frame of a reciprocating pump. The power end frame includes rings that are coupled to one another via a fastener assembly to define an interior and an exterior of the power end frame. The fastener assembly includes a rod that extends through the rings and locks that are coupled to the rod to compress the rings toward one another to couple the rings to one another. By way of example, the locks include nuts that are threaded onto the ends of the rod and abut the rings to compress the rings toward one another. In some embodiments, the fastener assembly supplements other components, such as welds, that couple the rings together. The fastener assembly provides additional structural support that reduces deflection of the power end frame. For example, the fastener assembly may increase a stiffness of a portion of the ring to block deformation that otherwise may occur during operation of the reciprocating pump (e.g., caused by a force imparted onto the portion of the ring). As such, the fastener assembly may help maintain a structural integrity of the power end frame to increase a useful lifespan of the power end frame.

Figure 1:
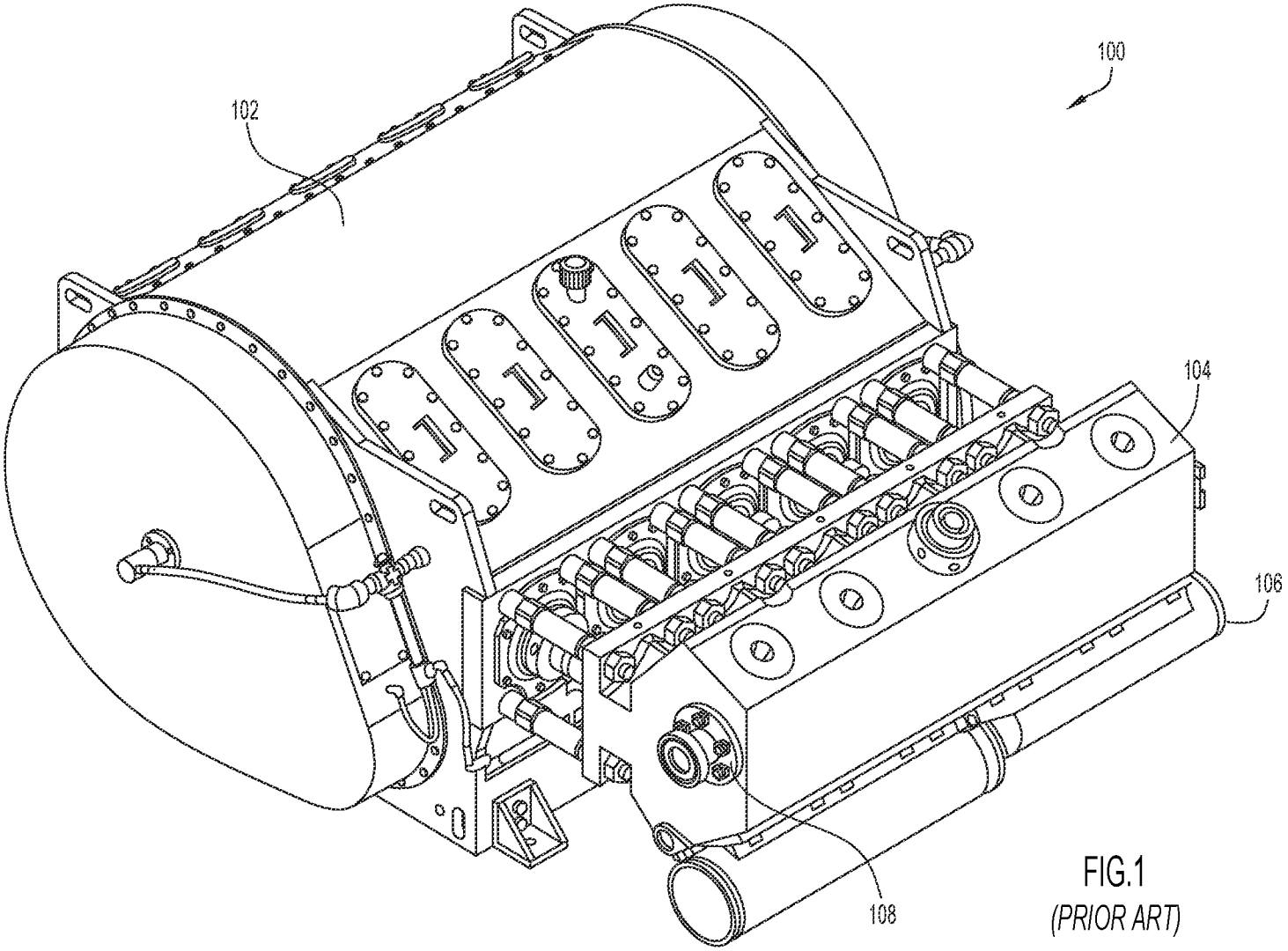
FIG.1 (PRIOR ART)
FIG. 1 is a front perspective view of a prior art reciprocating pump including a fluid end and a power end.

Referring to FIG. 1, a prior art reciprocating pump 100 is illustrated. The reciprocating pump 100 includes a power end 102 and a fluid end 104. The power end 102 includes a crankshaft that drives a plurality of reciprocating plungers or pistons (generally referred to as "reciprocating elements") enclosed within the fluid end 104 to pump fluid at high pressure (e.g., to cause the fluid end 104 to deliver high pressure fluids to earth drilling operations). For example, the power end 102 may be configured to support hydraulic fracturing (i.e., fracking) operations, where fracking liquid (e.g., a mixture of water, chemicals, and/or sand) is injected into rock formations at high pressures to allow natural oil and gas to be extracted from the rock formations. However, to be clear, this example is not intended to be limiting, and the present application may be applicable to both fracking and drilling operations, as well as any other suitable operations.

In any case, often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well to perform maintenance on the reciprocating pump 100. However, a reciprocating pump 100 is typically moved off a well only when a replacement pump (and an associated semi) is available to move into place at the well, which may be rare. Thus, often, the reciprocating pump 100 is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, extend the time between maintenance operations (i.e., between downtime), and/or minimize the time to complete maintenance operations (minimizing downtime) are highly desirable.

Figure 2A:
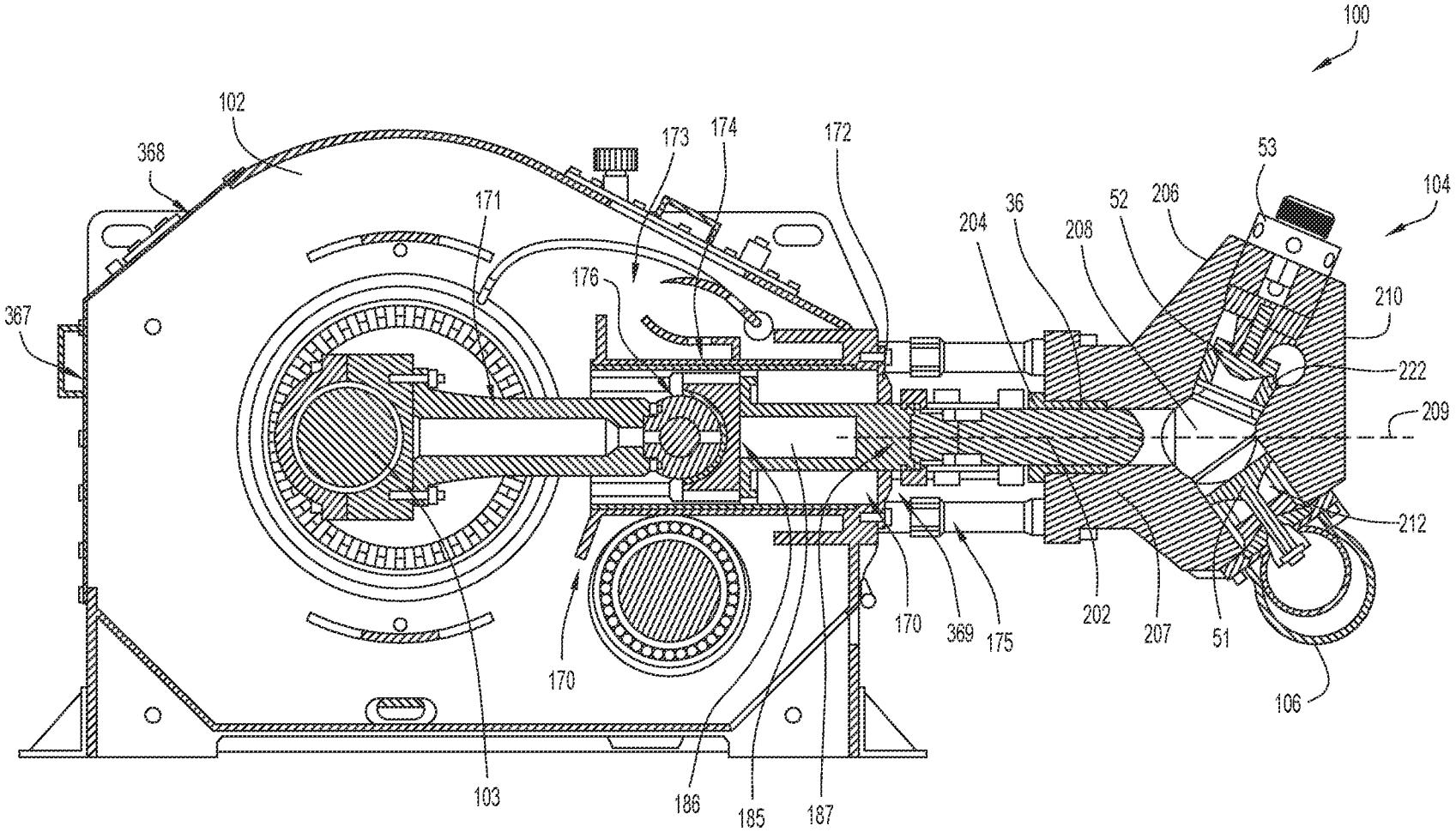
FIG.2A (PRIOR ART)
FIG. 2A is a side cross-sectional view of the prior art reciprocating pump of FIG. 1.

Still referring to FIG. 1, but now in combination with FIG. 2A, the reciprocating pump 100 pumps fluid into and out of pumping chambers 208. FIG. 2A shows a side, cross-sectional view of reciprocating pump 100 taken along a central axis 209 of one of the reciprocating elements 202 included in reciprocating pump 100. Thus, FIG. 2A depicts a single pumping chamber 208. However, it should be understood that a fluid end 104 can include multiple pumping chambers 208 arranged side-by-side. In fact, in at least some embodiments (e.g., the embodiment of FIG. 1), a casing 206 of the fluid end 104 forms a plurality of pumping chambers 208, and each pumping chamber 208 includes a reciprocating element 202 that reciprocates within the casing 206. However, side-by-side pumping chambers 208 need not be defined by a single casing 206. For example, in some embodiments, the fluid end 104 may be modular, and different casing segments may house one or more pumping chambers 208. In any case, the one or more pumping chambers 208 are arranged side-by-side so that corresponding conduits are positioned adjacent to each other and generate substantially parallel pumping action. Specifically, with each stroke of the reciprocating element 202, low pressure fluid is drawn into the pumping chamber 208 and high pressure fluid is discharged. During these operations, movement of the crankshaft 103, movement of the reciprocating element 202, and/or flow of fluid, as well as other moving parts, components, and/or flows, may generate stress at the power end 102. The stress can affect a structural integrity of the power end 102. Therefore, maintenance operations (e.g., inspection, replacement, repair) may be performed with respect to the power end 102 to ensure continued operation of the reciprocating pump 100.

In various embodiments, the fluid end 104 may be shaped differently and/or have different features, but may still generally perform the same functions, define similar structures, and house similar components. For example, while the fluid end 104 includes a first bore 204 that intersects an inlet bore 212 and an outlet bore 222 at skewed angles, other fluid ends may include any number of bores arranged along any desired angle or angles, for example, to intersect the first bore 204 (and/or an access bore) substantially orthogonally and/or so that two or more bores are substantially coaxial. Generally, the bores 212 and 222, as well as any other bores (i.e., segments, conduits, etc.), may intersect to form a pumping chamber 208, may be cylindrical or non-cylindrical, and may define openings at an external surface 210 of the casing 206. Additionally, the bores 212 and 222, as well as any other bores (i.e., segments, conduits, etc.), may receive various components or structures, such as sealing assemblies or components thereof.

In the depicted embodiment, the inlet bore 212 defines a fluid path through the fluid end 104 that connects the pumping chamber 208 to a piping system 106 delivering fluid to the fluid end 104. Meanwhile, the outlet bore 222 allows compressed fluid to exit the fluid end 104. Thus, in operation, the bores 212 and 222 may include valve components 51 and 52, respectively, (e.g., one-way valves) that allow the bores 212 and 222 to selectively open and deliver a fluid through the fluid end 104. Typically, valve components 51 in the inlet bore 212 may be secured therein by a piping system 106 (see FIG. 1). Meanwhile, valve components 52 in outlet bore 222 may be secured therein by a closure assembly 53 that, in the prior art example illustrated in FIG. 2A, is removably coupled to the fluid end 104 via threads.

In operation, fluid may enter fluid end 104 via outer openings of inlet bores 212 and exit fluid end 104 via outer openings of outlet bores 222. More specifically, fluid may enter inlet bores 212 via pipes of piping system 106, flow through the pumping chamber 208 (due to reciprocation of a reciprocating elements 202), and then through the outlet bores 222 into a channel 108 (see FIG. 1). However, the piping system 106 and the channel 108 are merely example conduits and, in various embodiments, the fluid end 104 may receive and discharge fluid via any number of pipes and/or conduits, along pathways of any desirable size or shape.

Meanwhile, each of the first bores 204 defines, at least in part, a cylinder for reciprocating elements 202 and/or connects the casing 206 to a cylinder for reciprocating elements 202. More specifically, in the illustrated embodiment, a casing segment 207 houses a packing assembly 36 configured to seal against a reciprocating element 202 disposed interiorly of the packing assembly 36. Reciprocation of a reciprocating element 202 in or adjacent to the first bore 204, which may be referred to as a reciprocation bore (or, for fracking applications, a plunger bore), draws fluid into the pumping chamber 208 via the inlet bore 212 and pumps the fluid out of the pumping chamber 208 via the outlet bore 222. To help provide access to these parts and/or the pumping chamber 208, such as for performing maintenance operations, some fluid ends 104 have access bores that are often aligned with (and sometimes coaxial with) the first bore 204. Other fluid ends 104 need not include an access bore and, thus, such an access bore is not illustrated in FIGS. 1 and 2A.

Regardless of whether the fluid end 104 includes an access bore, the packing assembly 36 typically is to be replaced from an outer opening of the first bore 204 (i.e., a side of the first bore 204 aligned with the external surface 210 of the casing 206). At the same time, to operate properly, the fluid end 104 is to be securely and stably coupled to the power end 102. Thus, often, with prior art reciprocating pumps like the reciprocating pump 100, the fluid end 104 is directly coupled to the power end 102 with relatively short couplers 175, and at least a portion of the reciprocating pump 100 is to be disassembled to access the first bore 204, e.g., to replace packing assembly 36.

Figure 2B:
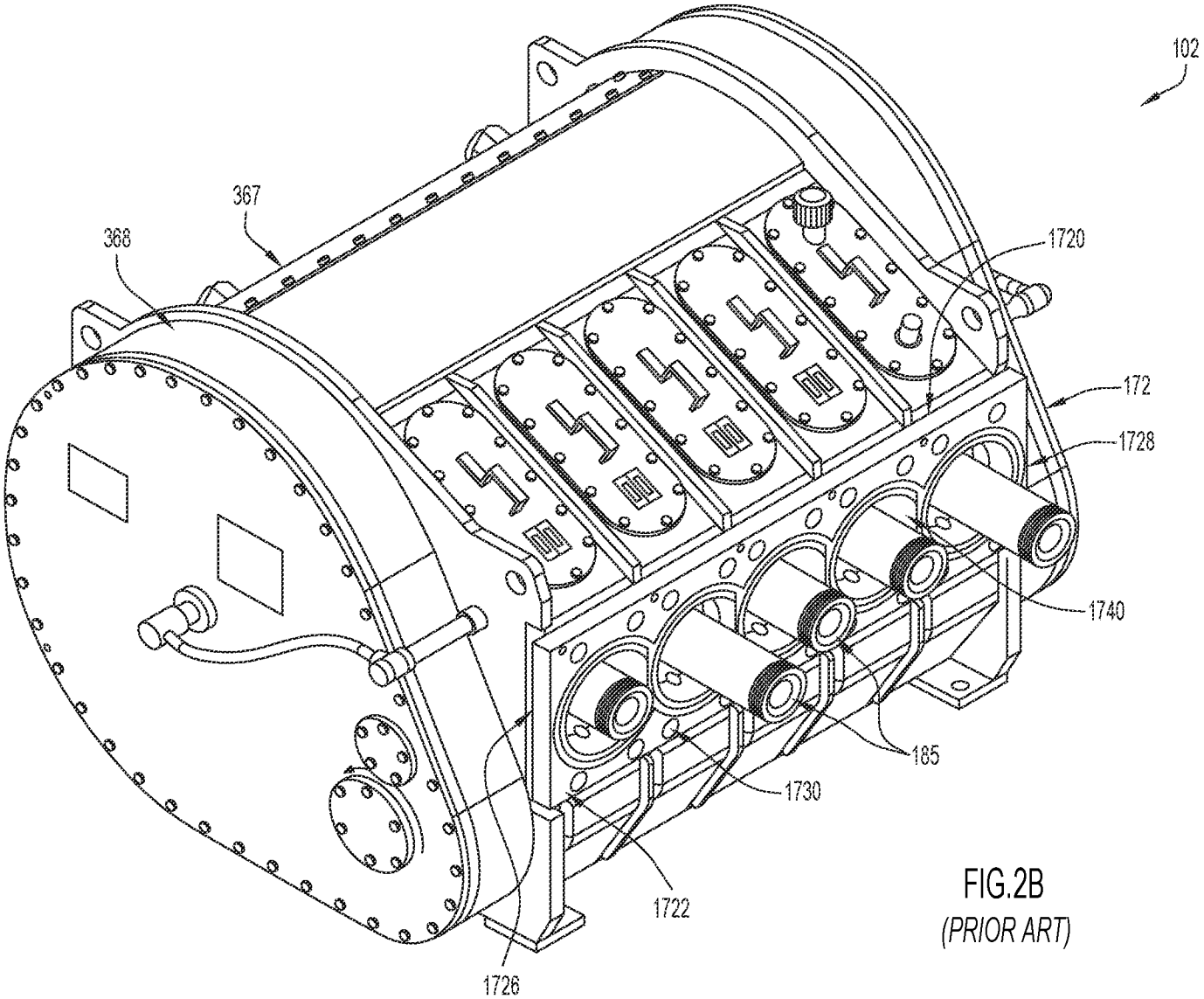
FIG.2B (PRIOR ART)
FIG. 2B is a front perspective view of a prior art power end.

Now turning to FIGS. 2A and 2B, in the depicted prior art reciprocating pump 100, couplers 175 (e.g., tie rods, which are sometimes referred to as stay rods) are threaded to a nose plate 172 of a crosshead assembly 170 of the power end 102 to position the fluid end 104 in close proximity to the power end 102. More specifically, with the prior art power end 102, the locations at which a fluid end 104 may be coupled to the power end 102 are fixed and/or preset by a set of receptacles 1730. In this particular prior art power end 102, the nose plate 172 defines the locations of receptacles 1730 for the power end 102 (which is positioned at and/or generally defines a front of the power end 102). However, in other embodiments, receptacles 1730 could be included in any part or portion of a power end. That is, the power end 102 may include a frame 368 that extends from a front 369 to a back 367, and the receptacles 1730 may generally be included in the front 369 of frame 368. Receptacles 1730 can be seen in FIG. 2B, which shows the power end 102 disconnected from the fluid end 104, e.g., during maintenance of the packing assembly 36 included in the fluid end 104. FIG. 2B also shows how, in this particular embodiment, the nose plate 172 extends from a first end 1726 to a second end 1728 and also extends from a back surface 1720 to a front surface 1722.

In the depicted embodiment, the receptacles 1730 extend into the nose plate 172 from the front surface 1722 and are generally disposed around pony rod holes 1740. However, in other embodiments, the receptacles 1730 need not be positioned as such. In any case, the receptacles 1730 may be threaded so that a threaded coupler 175 can be secured directly therein. Still further, in some instances, the receptacles 1730 need not extend through back surface 1720, which may prevent the couplers 175 from extending into the crosshead assembly 170 and interfering with operations of the crosshead assembly 170 and/or allowing contaminants into the crosshead assembly 170. However, other embodiments might include receptacles that are through holes.

Still referring to FIGS. 2A and 2B, in the prior art reciprocating pump 100—and in most high pressure reciprocating pumps—a crosshead frame 174 is a part of a crosshead assembly 170 that converts rotational motion of the crankshaft 103 into linear, reciprocating motion of a pony rod 185. More specifically, the crosshead assembly 170 includes a connecting rod 171, a crosshead 173, and a pony rod 185. The crosshead 173 includes a connector 176 disposed within a crosshead frame 174, and the connecting rod 171 extends from the crankshaft 103 to the connector 176. The connector 176 is configured to move linearly within the crosshead frame 174, and opposite ends of the connecting rod 171 are configured to travel with the crankshaft 103 and the connector 176.

Thus, as the connecting rod 171 rotates with the crankshaft 103, the connecting rod 171 reciprocates the connector 176 within the crosshead frame 174. The connector 176 is also connected to a back side 186 of the pony rod 185 so that the pony rod 185 reciprocates with the connector 176. Meanwhile, a front side 187 of the pony rod 185 can be coupled to a reciprocating element 202 (e.g., a plunger), such as via a clamp, to drive reciprocating motion of the reciprocating element 202 that pumps fluid through the fluid end 104. Notably, during this action, the pony rod 185 and/or the crosshead 173 exert forces on the frame 368. These forces stress the frame 368 (and potentially the crosshead frame 174). Such forces may affect a structural integrity of the frame 368. For this reason, forces imparted onto the frame 368 may wear out (e.g., decrease a useful lifespan of) the frame 368 and/or cause downtime of the power end 102, such as to enable performance of a maintenance operation with respect to the frame 368, thereby reducing effective operation of the reciprocating pump 100.

Figure 3A:
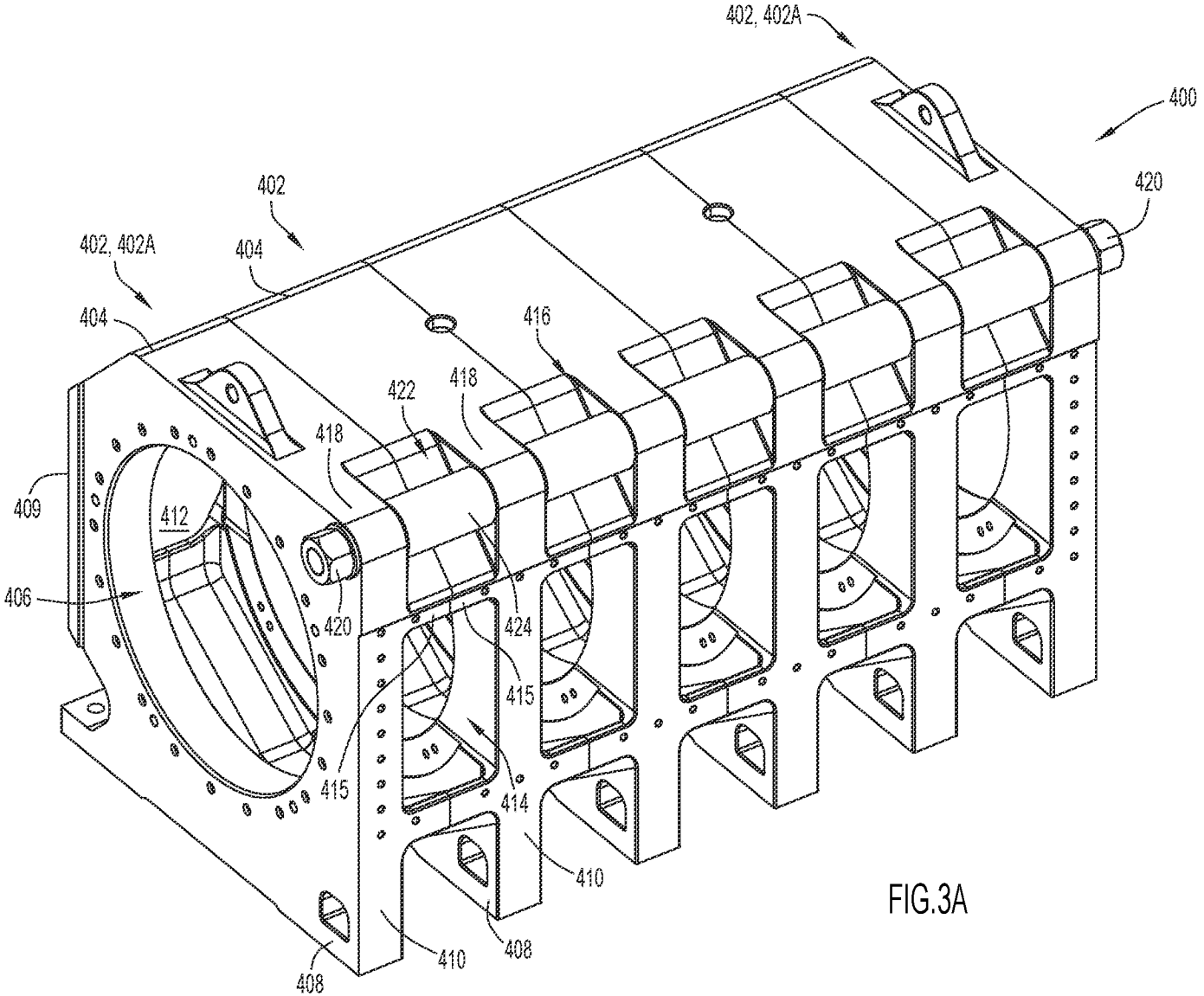
FIG. 3A is a rear perspective view of a power end frame of a reciprocating pump having a fastener assembly, according to an example embodiment of the present application.

FIG. 3A is a rear perspective view of a power end frame 400 of a power end of a reciprocating pump in an assembled configuration. The power end frame 400 is configured to enclose another component of the reciprocating pump, such as a portion of a crankshaft configured to operate a reciprocating element, in the assembled configuration. For visualization purposes, certain components, such as a crankshaft, a crosshead assembly, a nose plate, and rods, are not shown in FIG. 3A. The power end frame 400 is composed of multiple rings 402 coupled to one another. For instance, each ring 402 may include a base 404, and the base 404 of adjacent rings 402 abut one another. Each base 404 defines a respective opening 406 (e.g., a crankshaft bore) in which components (e.g., a crankshaft) of the power end may be positioned. Additionally, each ring 402 includes a stand 408 configured to support and stabilize placement of the rings 402, e.g., on a skid (not shown). As an example, the stands 408 may help balance and maintain a position of the rings 402, as well as support a weight of the power end frame 400. A fluid end (e.g., the fluid end 104) may be coupled to the power end frame 400, such as via a nose plate (not shown) configured to extend across a surface 409 of each ring 402.

The rings 402 cooperatively form an interior 412 of the power end frame 400. For example, the opening 406 of each ring 402 may align with one another. Additionally, portions of the bases 404 of adjacent rings 402 are offset from one another to form a compartment 414 (e.g., a gap, a space) therebetween. To this end, the bases 404 include lips 415 configured to abut one another to form the compartments 414. The openings 406 and the compartments 414 cooperatively form the interior 412. As such, certain components of the power end may be positioned within the openings 406 and/or within the compartments 414.

A fastener assembly 416 is configured to couple the rings 402 to one another. As an example, each ring 402 may include a flange 418 extending from the base 404 away from the interior 412. A rod or bolt (not shown) of the fastener assembly 416 extends through each flange 418 at an exterior of the power end frame 400. Locks 420 are coupled to ends of the rod and abut against the flange 418 of end rings 402A positioned at opposite ends of the power end frame 400. For example, the locks 420 may include nuts configured to threadedly engage the ends of the rod. Abutment of the locks 420 against the flanges 418 of the end rings 402A compresses the rings 402 against one another to restrict movement of the rings 402 relative to one another, thereby securing the rings 402 together. In some embodiments, a space 422 spans between the flanges 418 of adjacent rings 402. In such embodiments, sleeves or spacers 424 are positioned within the space 422 between adjacent rings 402 to block unwanted deformation of the flanges 418 during compression of the rings 402 to one another. That is, the flanges 418 of the rings 402 abut against the sleeves 424 to prevent or at least discourage further deflection and movement of the flanges 418 during compression. Consequently, the sleeves 424 restrict movement of the rings 402 relative to one another to help secure the rings 402 together. The rod extends through each of the sleeves 424 to secure the sleeves within the space 422. In additional or alternative embodiments, the rod may not extend through the sleeves positioned within the space 422.

The fastener assembly 416 provides support at and between the rings 402 to stiffen the power end frame 400. As an example, the fastener assembly 416 may block relative movement of the rings 402 at and adjacent to the flanges 418 (e.g., via compression of the flanges 418 to one another). Thus, deflection at such portions of the rings 402, which otherwise may occur during operation of the reciprocating pump as a result of produced forces imparted on the rings 402, may be prevented or at least discouraged. Indeed, the fastener assembly 416 may absorb such forces imparted on the portions of the ring 402. As such, the fastener assembly 416 may reduce or limit additional stress that, for instance, may be imparted on the flanges 418. Additionally, by limiting deformation of the rings 402, the fastener assembly 416 may also reduce or limit additional stress that may otherwise be produced as a result of deformation of the rings 402, such as of the flanges 418 (e.g., to affect engagement with an adjacent ring 402). Accordingly, the fastener assembly 416 may reduce fatigue of the rings 402 to help maintain a structural integrity of the power end frame 400.

By way of example, the flange 418 may extend from a surface 410, opposite of the surface 409 configured to couple to the fluid end. Thus, the flange 418 may extend away from the surface 409 and the fluid end. Implementation of the fastener assembly 416 at the flange 418 extending from the surface 410 may be particularly beneficial for limiting an excessive amount of forces from being imparted on the power end frame 400 that could otherwise deform the rings 402. However, an additional or alternative fastener assembly may be implemented at another portion of the power end frame 400, such as at the surface 409 and/or adjacent to the stands 408.

Moreover, the fastener assembly 416 may provide greater stability as compared to another type of coupling technique, such as a weld. For example, the fastener assembly 416 may be configured to absorb a greater amount of force without reducing coupling of the rings 402 to one another. Thus, the fastener assembly 416 may more effectively increase the stiffness of the power end frame 400 and reduce potential fatigue at the rings 402, which otherwise may occur by coupling the rings 402 to one another using welds alone. Thus, the fastener assembly 416 may provide sufficient structural securement of the rings 402 to one another without usage of welds. Alternatively, in certain embodiments, the fastener assembly 416 may supplement another coupling technique used to couple the rings 402 to one another. For instance, welds may be applied at the bases 404 (e.g., at the lips 415) to couple the bases 404 to one another, and the fastener assembly 416 may be implemented to couple the flanges 418 to one another. It should be noted, however, that the fastener assembly 416 may reduce a quantity or amount of welds used to couple the rings 402 to one another, which may in turn reduce a cost associated with manufacture of the power end frame 400.

Further still, the fastener assembly 416 enables sufficient accessibility within the power end frame 400. As an example, the positioning of the fastener assembly 416 at an exterior of the power end frame 400 may avoid blocking the interior 412 of the power end frame 400. As another example, the fastener assembly 416 may be readily removable (e.g., by removing the rod) to enable the rings 402 to be separated from one another for access to the interior 412 of the power end frame 400. Thus, the fastener assembly 416 increases flexibility of adjusting a configuration of the fastener assembly 416, such as for performing an inspection, a maintenance, and/or a modification of the power end frame 400.

Figure 3B:
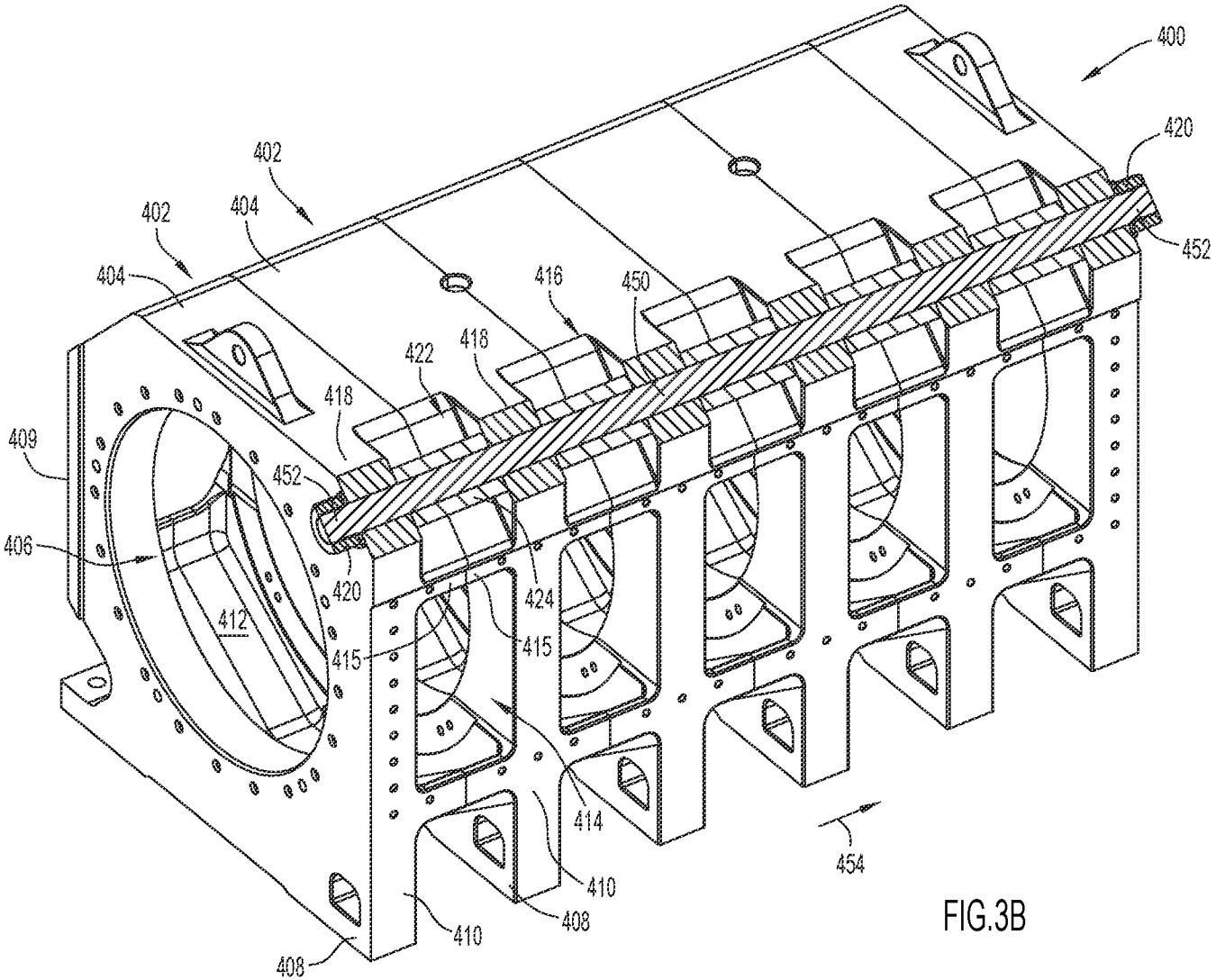
FIG. 3B is a rear perspective view the power end frame of FIG. 3A illustrating a cross-section of the fastener assembly.

FIG. 3B is a rear perspective view of the power end frame 400 illustrating a cross-section of the fastener assembly 416. The illustrated embodiment includes a rod or bolt 450 (e.g., a tie rod, a tie bolt) extending through the flanges 418 of each ring 402 and through the sleeves 424 positioned between the flanges 418. Ends 452 of the rod 450 extend beyond a lateral boundary of the rings 402 and are therefore exposed to enable the locks 420 to be coupled to (e.g., threaded on) the ends 452.

In the illustrated embodiment, the rings 402 are positioned (e.g., stacked) next to one another along an axis 454, and the rod 450 extends along the axis 454 through the flanges 418 and sleeves 424. In other words, the rod 450 extends in generally the same direction along which the rings 402 are positioned adjacent to one another. However, in additional or alternative embodiments, the rod 450 may extend in a different direction along which the rings 402 are positioned adjacent to one another. Furthermore, although a single rod 450 extending through the rings 402 is shown, in additional or alternative embodiments, the power end frame 400 may include multiple rods. As an example, each of the rods may extend through all of the rings 402. As another example, each rod may extend through different rings 402. For instance, a first rod may extend through a subset of the rings 402, and a second rod may extend through a remainder of the rings 402. Indeed, any suitable arrangement of rods may be utilized to secure the rings 402 to one another.

Figure 4:
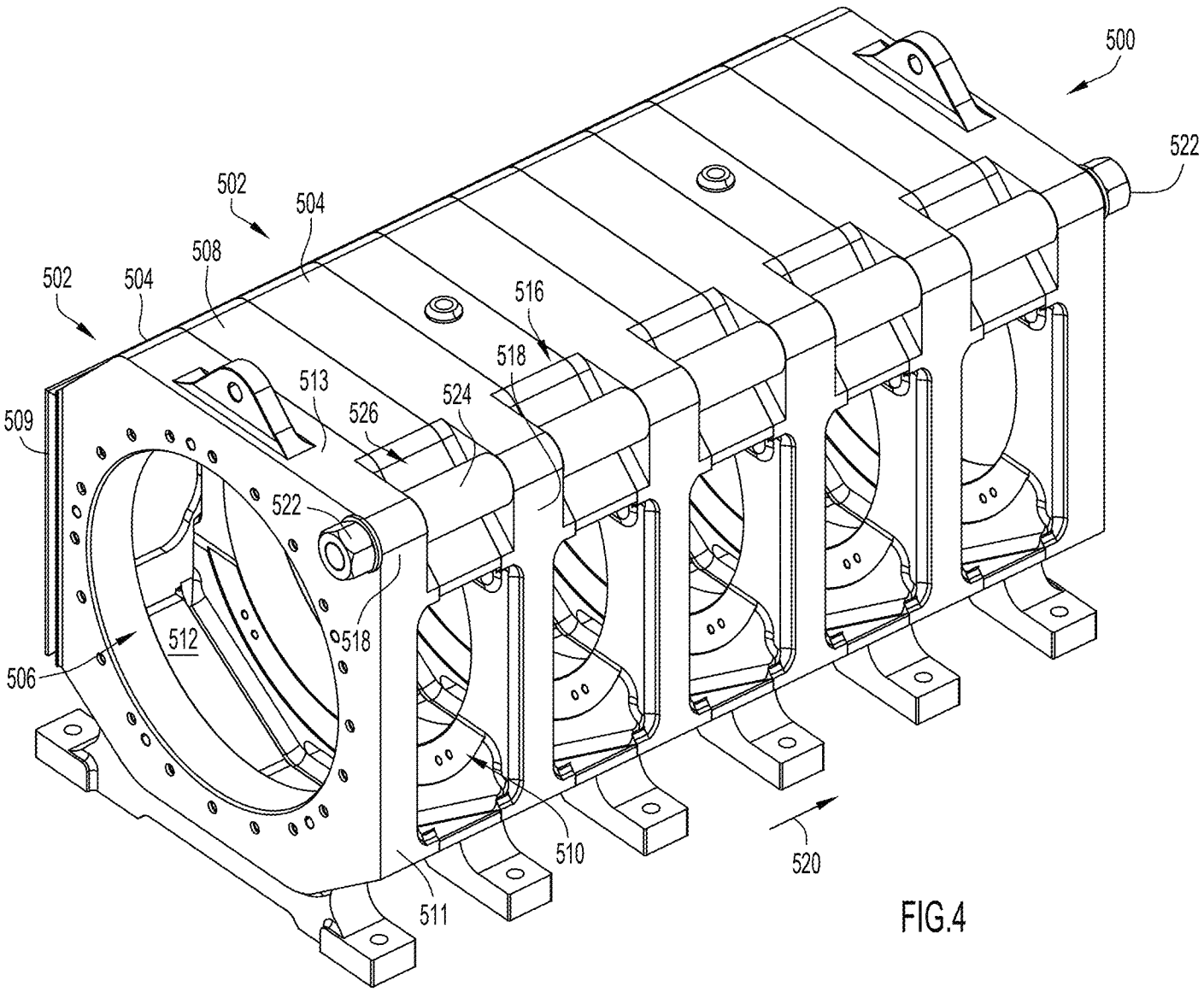
FIG. 4 is a rear perspective view of another power end frame of a reciprocating pump having a fastener assembly, according to an example embodiment of the present application.

FIG. 4 is a rear perspective view of a power end frame 500. The power end frame 500 includes rings 502 that have a base 504 defining a respective opening 506. In addition, plates 508 are positioned between and abut adjacent rings 502. The positioning of the plates 508 between the rings 502 provide compartments 510 between the bases 504. That is, the rings 502 do not directly contact one another in the power end frame 500 and are offset by the compartments 510. As such, the rings 502 and the bases 504 cooperatively form an interior 512 of the power end frame 500. A fluid end (e.g., the fluid end 104) may be coupled to the power end frame 500, such as via a nose plate (not shown) configured to extend across a first surface 509 of each ring 502.

A fastener assembly 516 is configured to couple the rings 502 to one another. To this end, each ring 502 includes a flange 518 extending from the base 504 away from the interior 512 and away from the plates 508, and a rod or bolt (not shown) of the fastener assembly 516 extends through each flange 518. For example, each ring 502 may include a second surface 511, opposite to and facing away from the first surface 509, as well as a third surface 513 extending between the first surface 509 and the second surface 511. The second surface 511 and the third surface 513 intersect to cooperatively define the flange 518. That is, the flange 518 extends from each of the second surface 511 and the third surface 513 and away from the first surface 509. The rod may extend along an axis 520 along which the rings 502 are positioned adjacent to one another, an end of the rod may extend laterally beyond the rings 502 along the axis 520, and locks 522 may couple to (e.g., threadedly engage) the ends to compress the flanges 518 and therefore the rings 502 against one another. Sleeves 524 are positioned between spaces 526 spanning between the flanges 518 of adjacent rings 502 to block deformation of the flanges 518 during compression of the rings 502 to one another. Thus, each sleeve 524 extends in overlap with a corresponding plate 508 between adjacent rings 502.

In some embodiments, the fastener assembly 516 supplements another coupling technique. By way of example, welds may be applied at the bases 504 and/or at the plates 508 to couple the rings 502 and plates 508 to one another. However, in alternative embodiments, the fastener assembly 516 couples the rings 502 and plates 508 to one another without usage of welds or another coupling technique.

Figure 5:
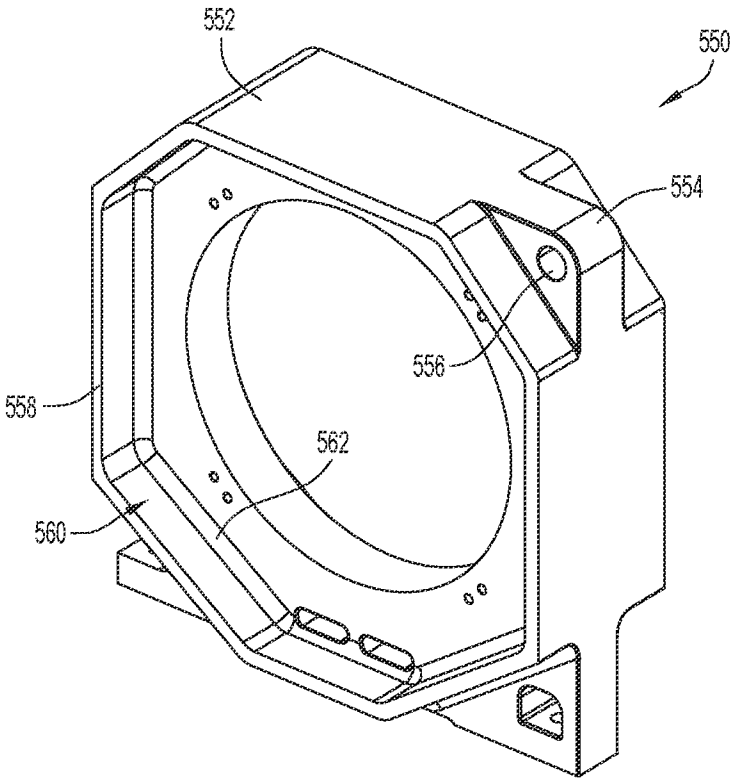
FIG. 5 is a rear perspective view of a ring of a power end frame of a reciprocating pump, according to an example embodiment of the present application.

FIG. 5 is a rear perspective view of a ring 550, such as one of the rings 402 and/or one of the rings 502, of a power end frame. The ring 550 includes a base 552 and a flange 554 extending from the base 552. The flange 554 includes a hole 556 configured to receive a rod of a fastening assembly for coupling the ring 550 to an adjacent ring 550 or an adjacent plate of the power end frame. The flange 554 has a triangular shape extending from the base 552 in the illustrated embodiment to provide a rounded corner of the ring 550, but the flange 554 may have any suitable shape in additional or alternative embodiments.

Furthermore, the base 552 includes a lip 558 that extends and is configured to abut an adjacent ring 550 or an adjacent plate to form a compartment. The lip 558 also creates a recess 560 that offsets a corner 562 from the adjacent ring 550 or the adjacent plate. As such, the corner 562 is positioned away from the abutment with the adjacent ring 550 or with the adjacent plate. Thus, stress imparted on the corner 562 (e.g., stress concentrating at the corner due to a geometric discontinuity of the corner 562) is away from the interface between the ring 550 and the adjacent ring 550 or the adjacent plate. Consequently, the effect of such stress on the coupling of the ring 550 to the adjacent ring 550 or to the adjacent plate may be reduced. As such, the coupling of the ring 550 to the adjacent ring 550 or to the adjacent plate may be maintained. For this reason, the lip 558 may increase structural rigidity of the power end frame.

Figure 6:
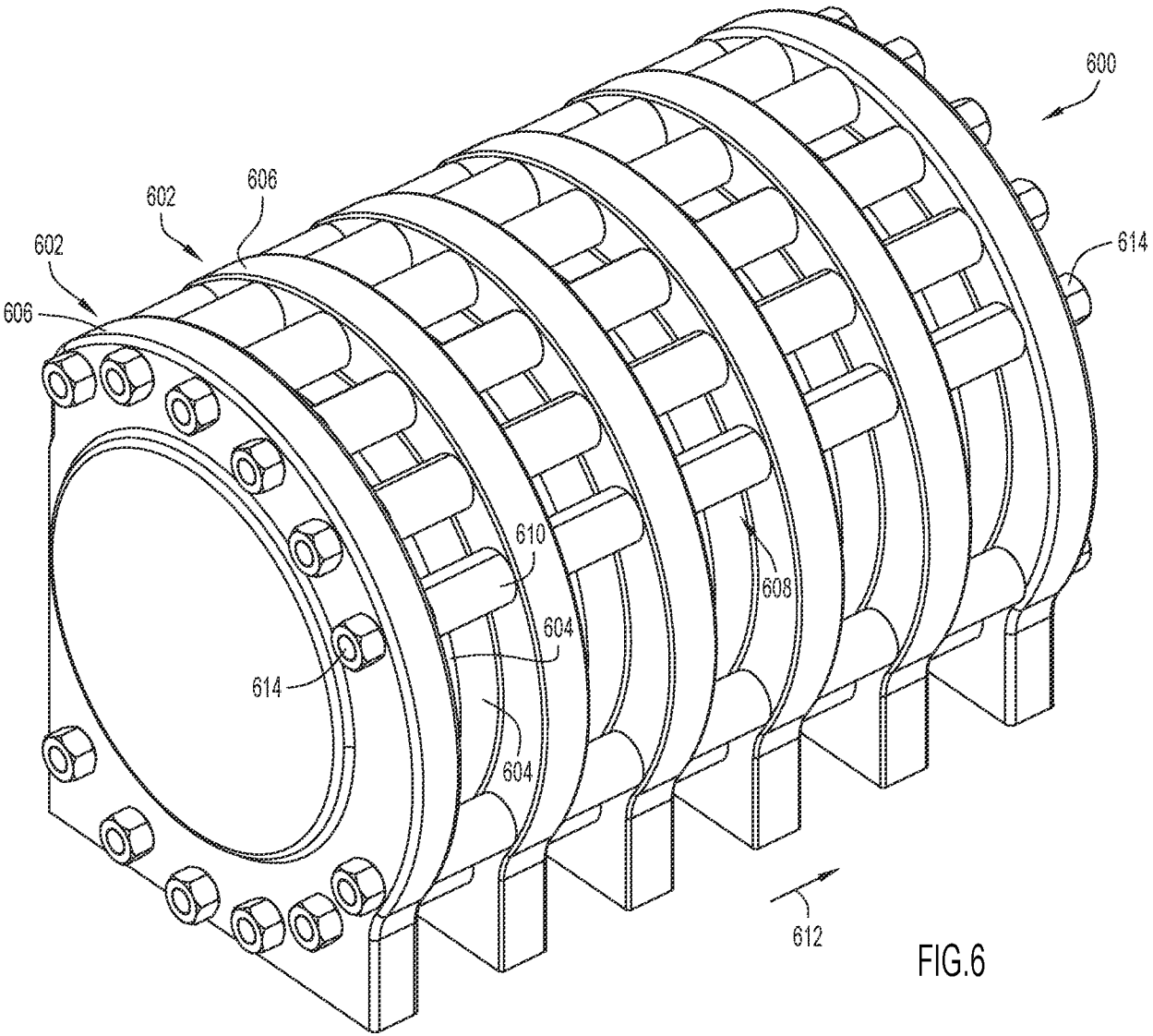
FIG. 6 is a rear perspective view of yet another power end frame of a reciprocating pump having a fastener assembly, according to an example embodiment of the present application.

FIG. 6 is a rear perspective view of a power end frame 600. The power end frame 600 includes rings 602 that are coupled to one another. Each ring 602 includes a base 604 and a flange 606 extending from the base 604. For example, the base 604 may have a circular shape, and the flange 606 may extend radially from the base 604. Thus, the flange 606 may surround (e.g., circumferentially surround) at least a portion of a perimeter of the base 604. The bases 604 of adjacent rings 602 abut one another in the illustrated embodiment. However, in additional or alternative embodiments, the power end frame 600 may include plates positioned between adjacent rings 602 such that adjacent rings 602 are not in direct contact with one another.

A fastener assembly 608 is configured to couple the rings 602 to one another. For example, because the flange 606 of each ring 602 surrounds a perimeter of the base 604, each flange 606 may accommodate multiple rods or bolts (not shown) of the fastener assembly 608 inserted therethrough. That is, rods may extend through different portions of the flange 606 to secure the rings 602 to one another. Sleeves 610 are positioned between the flanges 606 of adjacent rings 602 to block deformation of the flanges 606 and facilitate coupling of the rings 602 to one another. Additionally, ends of each rod extend beyond a lateral boundary of the rings 602 (e.g., along an axis 612 along which the rings 602 are positioned adjacent to one another), and locks 614 couple to the ends of the rod to compress the flanges 606 of the rings 602 to one another, thereby securing the rings 602 together.

In some embodiments, the fastener assembly 608 having rods extending through different portions of the flanges 606 may sufficiently couple the rings 602 to one another without having to use an additional coupling technique, such as welds. Indeed, by distributing the rods about the rings 602, movement (e.g., deformation) of different parts of the rings 602 relative to one another may be blocked. However, in additional or alternative embodiments, the fastener assembly 608 may supplement another coupling technique.

Figure 7:
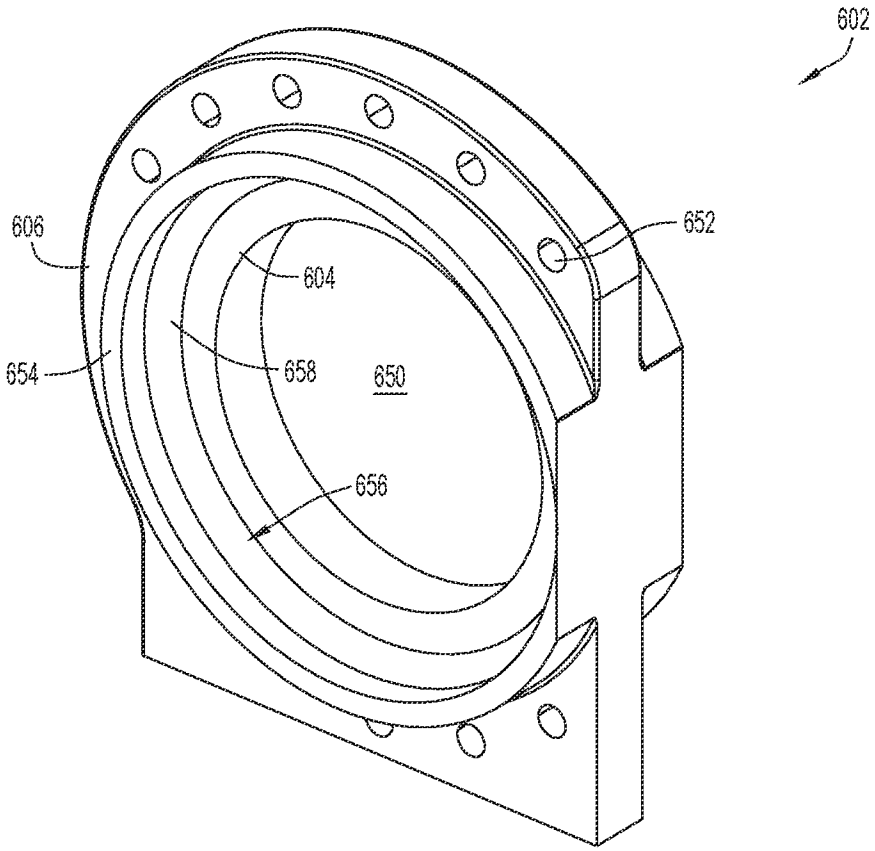
FIG. 7 is a rear perspective view of a ring of the power end frame of FIG. 6.

FIG. 7 is a rear perspective view of the ring 602 of the power end frame 600. The base 604 of the ring 602 defines an opening 650, and the opening 650 cooperatively defines an interior of the power end frame 600 with openings 650 of other rings 602 in an assembled configuration. Holes 652 are distributed about the flange 606. The holes 652 are configured to align with corresponding holes 652 of an adjacent ring 602 to enable a rod of the fastener assembly 608 to extend through the aligned holes 652 and couple the ring 602 and the adjacent ring 602 to one another.

The base 604 includes a lip 654 that extends and is configured to abut an adjacent ring 602 or an adjacent plate. The lip 654 creates a recess 656 that offsets a corner 658 from the adjacent ring 602 or the adjacent plate. Thus, the corner 658 is positioned away from the abutment with the adjacent ring 602 or with the adjacent plate to reduce an amount of stress imparted at the interface between the ring 602 and the adjacent ring 602 or the adjacent plate, thereby maintaining the coupling of the ring 602 to the adjacent ring 602 or to the adjacent plate to increase structural rigidity of the power end frame 600.

Figure 8:
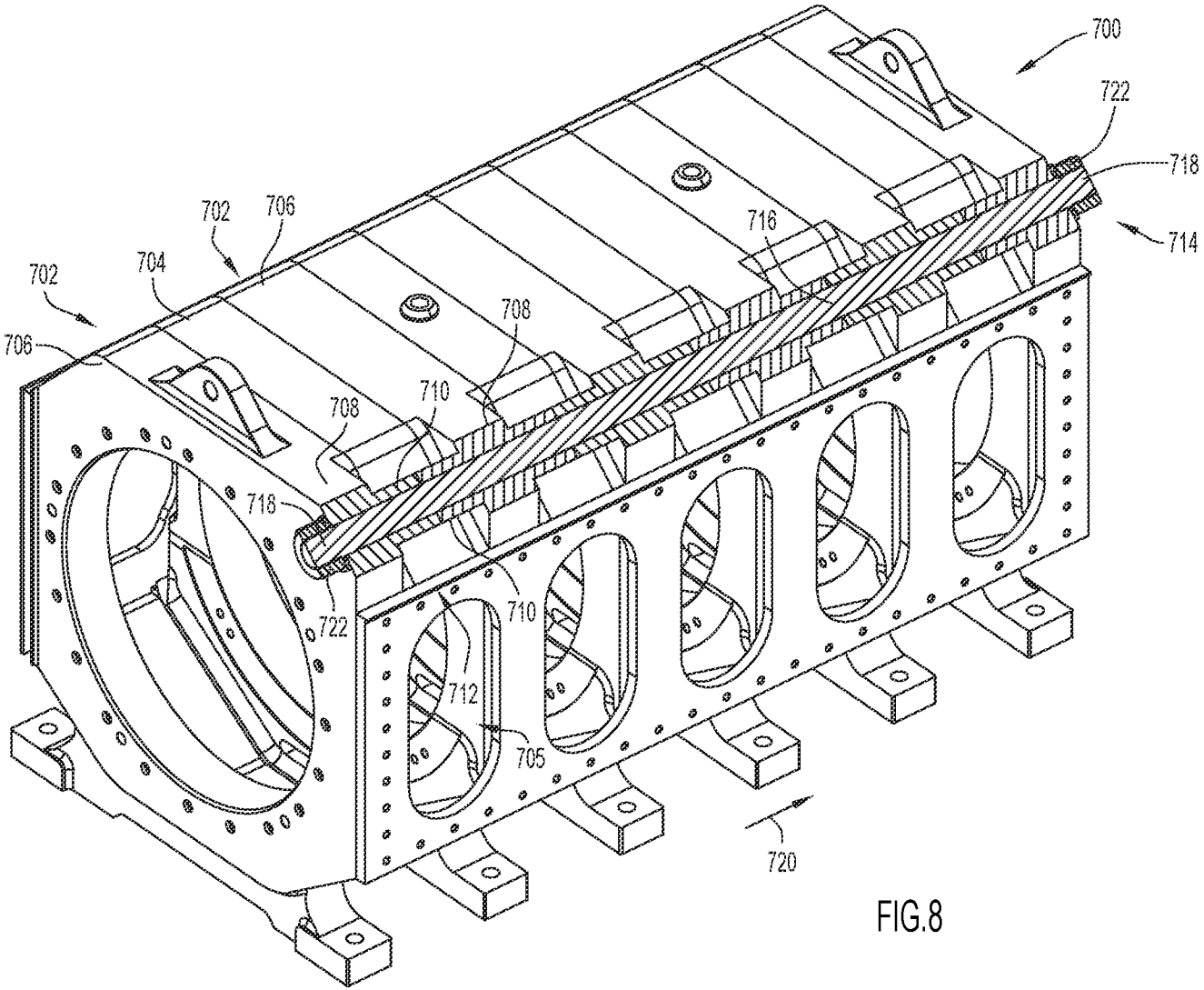
FIG. 8 is a rear perspective view of still another power end frame of a reciprocating pump having a fastener assembly, according to an example embodiment of the present application.

FIG. 8 is a rear perspective view of a power end frame 700. The power end frame 700 includes rings 702 and plates 704 positioned between adjacent rings 702. Thus, the plates 704 offset the rings 702 from one another to create compartments 705. However, in additional or alternative embodiments, the rings 702 (e.g., bases 706 of the rings 702) may directly abut one another.

Each ring 702 also includes a flange 708 extending from the base 706, as well as extensions 710 extending from the flange 708. The extensions 710 of adjacent rings 702 are configured to abut one another. For instance, the plate 704 offsets the adjacent rings 702 from one another to form a space 712 between the flanges 708, and the extensions 710 cooperatively span the space 712. The extensions 710 and flanges 708 accommodate a fastener assembly 714 for securing the rings 702 and the plates 704 to one another. Specifically, FIG. 8 illustrates a cross-section of the fastener assembly 714 to show a rod or bolt 716 extending through the extensions 710 and the flanges 708 of each ring 702. Ends 718 of the rod 716 extend beyond a lateral boundary of the rings 702 (e.g., along an axis 720 along which the rings 702 are positioned adjacent to one another), and locks 722 are coupled to the ends 718 to compress the flanges 708 to one another, which may cause the extensions 710 of adjacent rings 702 to abut one another. Thus, the extensions 710 block further deformation of the flanges 708 and enable the fastener assembly 714 to secure the rings 702 to one another without having to position sleeves between the flanges 708. Therefore, the extensions 710 may facilitate an case of manufacture of the power end frame 700 and/or reduce a cost associated with manufacture of the power end frame 700 (e.g., by reducing a quantity of components to be manufactured).

The fastener assembly 714 may be used as the only coupling technique or may supplement an additional coupling technique, such as welds, to couple the rings 702 to one another. Additionally, in certain embodiments, the flanges 708 may accommodate extension of multiple rods 716 therethrough. By way of example, the flanges 708 may surround a perimeter of the base 706, and the extensions 710 may extend from different portions of each flange 708. The rod 716 may be inserted through each extension 710 at the different portions. Thus, the fastener assembly 714 may be distributed around the rings 702 to provide greater securement of the rings 702 together.

Figure 9:
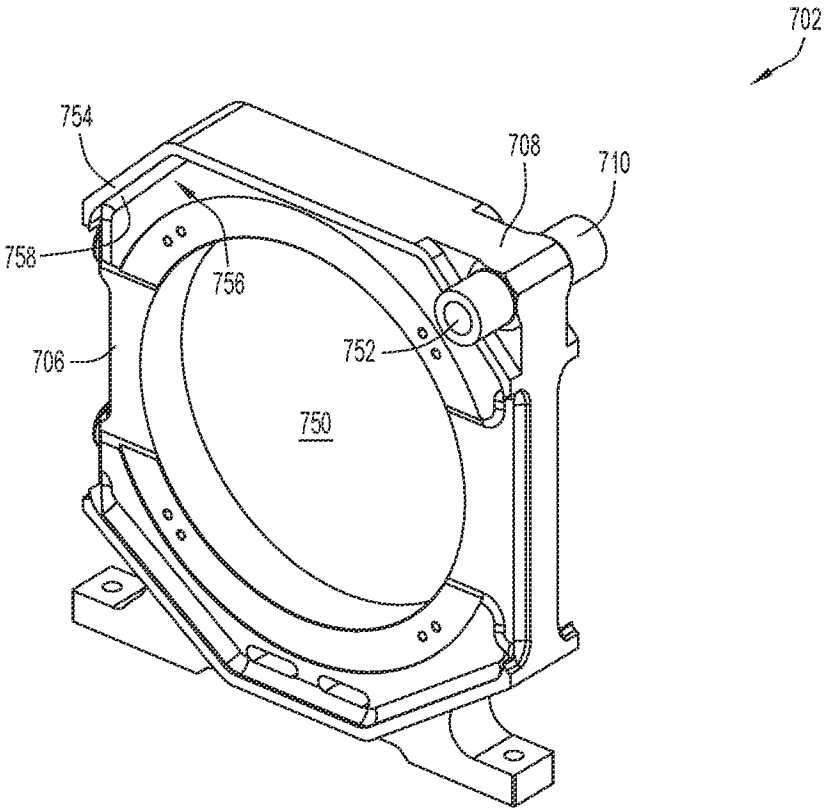
FIG. 9 is a rear perspective view of a ring of the power end frame of FIG. 8.

FIG. 9 is a perspective view of one of the rings 702 of the power end frame 700. The base 706 of the ring 702 defines an opening 750, and the opening 750 cooperatively defines an interior of the power end frame 700 with openings 750 of other rings 702 in an assembled configuration. Holes 752 extend through the extensions 710 and the flange 708 to enable insertion of the rod 716 therethrough. Although the extensions 710 are cylindrical in the illustrated embodiment, the extensions 710 can have any suitable shape in additional or alternative embodiments.

The ring 702 includes a lip 754 that extends and is configured to abut an adjacent ring 702 or an adjacent plate 704. The lip 754 creates a recess 756 that offsets a corner 758 from the adjacent ring 702 or the adjacent plate 704 to reduce an amount of stress imparted at the interface between the ring 702 and the adjacent ring 702 or the adjacent plate 704. Thus, coupling of the ring 702 to the adjacent ring 702 or to the adjacent plate 704 is maintained to increase structural rigidity of the power end frame 700.

It should be noted that other embodiments of power end frames having rings that are coupled to one another using a fastener assembly may be provided. By way of example, the rings may have flanges that are directly in contact with one another. In other words, there is no substantial space formed between the flanges of adjacent rings. In such embodiments, a rod of the fastener assembly may be inserted through each flange to compress the flanges to one another without usage of a sleeve positioned between the flanges and/or extensions that extend between the flanges.

Figure 10:
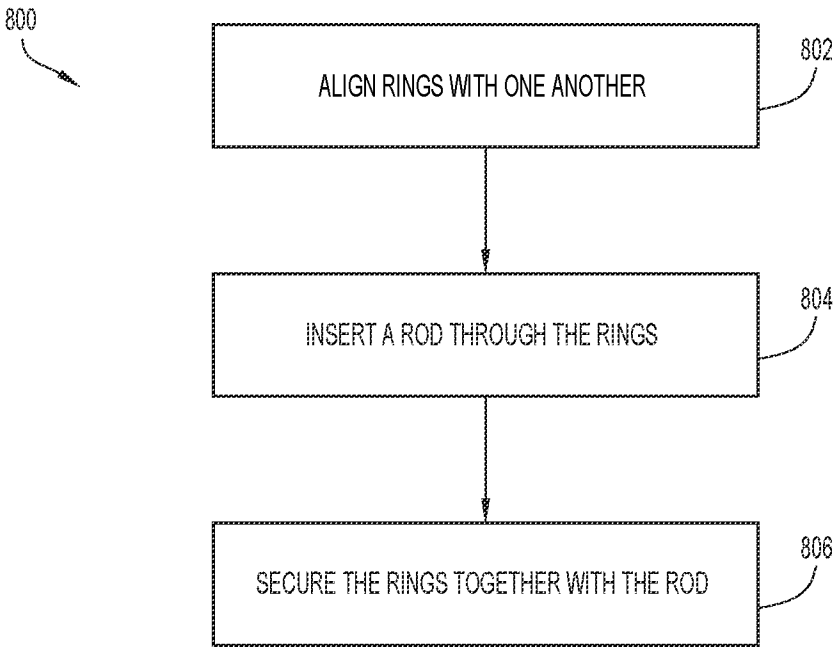
FIG. 10 is a flowchart of a method of manufacture of a power end frame of a reciprocating pump, according to an example embodiment of the present application.

FIG. 10 is a flowchart of a method 800 of manufacture of a power end frame, such as any of the power end frame 400, 500, 600, 700 discussed herein. It should be noted that the method 800 may be performed differently in additional or alternative embodiments. For example, an additional operation may be performed, and/or any of the operations of the method 800 may be performed differently, performed in a different order, or not performed.

At block 802, rings of the power end frame are aligned with one another. For instance, each ring includes a base that defines an opening, and the openings of the rings are concentrically aligned with one another. Moreover, each ring includes a flange that extends from the base, and each flange has a hole. Alignment of the rings with one another concentrically aligns the holes with one another.

Alignment of the rings positions the rings adjacent to one another along an axis. In some embodiments, the power end frame includes plate positioned between adjacent rings. In such embodiments, the plates offset the rings from one another such that the rings are not in direct contact with one another. In additional or alternative embodiments, the power end frame does not include plates, and the rings directly contact one another.

In either case, the flanges of adjacent rings may be offset from one another to create a space therebetween. In certain embodiments, sleeves are positioned within the space. Each sleeve includes a hole, and the sleeves are positioned to align the holes concentrically with the holes of the flanges. Additionally or alternatively, extensions extend from each flange, and the extensions of adjacent rings cooperatively span the space between the flanges of the adjacent rings. Each extension includes a hole that is concentrically aligned with one another.

At block 804, a rod or bolt is inserted through the holes of the flanges of the rings. Thus, the rod extends through each ring of the power end frame, such as along the axis along which the rings are positioned adjacent to one another. In embodiments in which sleeves are positioned between the flanges of adjacent rings, the rod is also inserted through the holes of the sleeves. In embodiments in which extensions span the space between the flanges of adjacent rings, the rod is inserted through the holes of the extensions.

At block 806, the rings are secured together with the rod. By way of example, insertion of the rod through the rings may position ends of the rings beyond a lateral boundary of the rings, and locks may be coupled to (e.g., threadedly engage) the rod. The locks may abut end rings and impart a force to place the rod under tension and to compress the flanges of the rings to one another to secure the rings together. The sleeves positioned between the flanges of adjacent rings and/or extensions extending between the flanges of adjacent rings block excessive deflection of the flanges to enable securement of the rings to one another.

In some embodiments, the locks are coupled to provide a target amount of compressive force (e.g., a clamp load) to maintain a desirable stiffness of the power end frame. For example, the target amount of compressive force may enable the rod to absorb forces (e.g., during operation of the power end frame) that otherwise may cause the rings to deflect. Thus, the locks may be selectively coupled to secure the rings to one another in a desirable manner.

In certain embodiments, an additional coupling technique, such as welding, is used to secure the rings to one another. In such embodiments, the rod may be inserted before, after, or during implementation of the additional coupling technique. Furthermore, certain operations of the method 800 may be repeated. For example, multiple rods may be implemented by inserting multiple rods through the rings (e.g., at different portions of the flanges) and securing the rings together with each rod. Thus, different parts of the rings may be secured to one another and further increase structural rigidity of the power end frame.

While the disclosure has been illustrated and described in detail and with reference to specific embodiments thereof, it is nevertheless not intended to be limited to the details shown, since it will be apparent that various modifications and structural changes may be made therein without departing from the scope and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present disclosure cover the modifications and variations of this disclosure that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A method of manufacture of a power end frame of a reciprocating pump, comprising:

aligning a plurality of rings with one another to define an interior of the power end frame configured to enclose a portion of a crankshaft of a power end of the reciprocating pump, wherein each ring, including a first ring and a second ring, of the plurality of rings comprises a flange, and aligning the plurality of rings with one another provides a space between the flange of the first ring of the plurality of rings and the flange of the second ring of the plurality of rings;

positioning a sleeve within the space between the flange of the first ring and the flange of the second ring;

inserting a rod through the plurality of rings; and securing the plurality of rings together with the rod such that the sleeve abuts the flange of the first ring and the flange of the second ring.

2. The method of claim 1, wherein securing the plurality of rings comprises coupling a lock to an end of the rod, the end of the rod extending beyond a lateral boundary of the plurality of rings.

3. The method of claim 1, wherein aligning the plurality of rings with one another comprises aligning a respective hole formed through each ring of the plurality of rings with one another, and inserting the rod through the plurality of rings comprises inserting the rod through each respective hole formed through each ring of the plurality of rings.

4. The method of claim 1, comprising inserting the rod through the plurality of rings and the sleeve.

5. The method of claim 1, comprising positioning plates between adjacent rings of the plurality of rings.

6. The method of claim 5, wherein inserting the rod through the plurality of rings comprises inserting the rod across the plates.

7. A reciprocating pump, comprising:

a fluid end configured to enclose a reciprocating element configured to receive and discharge fluid; and a power end configured to enclose a portion of a crankshaft configured to operate the reciprocating element, wherein the power end comprises:

a plurality of rings, wherein each ring of the plurality of rings comprises a base, a flange extending from the base, a first surface configured to couple to the fluid end, a second surface opposite to and facing away from the first surface, and a third surface extending between the first surface and the second surface, and wherein the second surface and the third surface intersect to cooperatively define the flange; and a rod extending through the flange of each ring of the plurality of rings.

8. The reciprocating pump of claim 7, wherein the flange extends away from the first surface.

9. The reciprocating pump of claim 7, comprising a sleeve positioned between and abutting the flange of a first ring of the plurality of rings and the flange of a second ring of the plurality of rings.

10. The reciprocating pump of claim 7, wherein each ring of the plurality of rings is positioned adjacent to one another along an axis, and the rod extends through the flange of each ring of the plurality of rings along the axis.

11. The reciprocating pump of claim 7, wherein each ring of the plurality of rings comprises an opening, the openings of the plurality of rings cooperatively define an interior of the power end, and the flange of each ring of the plurality of rings extends away from the interior of the power end.

* * * * *